US010352570B2

(12) United States Patent
Venkatesan et al.

(10) Patent No.: US 10,352,570 B2
(45) Date of Patent: Jul. 16, 2019

(54) TURBINE ENGINE FUEL INJECTION SYSTEM AND METHODS OF ASSEMBLING THE SAME

(71) Applicant: General Electric Company, Schenectady, NY (US)

(72) Inventors: Krishnakumar Venkatesan, Clifton Park, NY (US); Michael Anthony Benjamin, Cincinnati, OH (US); Shih-Yang Hsieh, Cohoes, NY (US); Yuxin Zhang, Niskayuna, NY (US); Owen James Sullivan Rickey, Saratoga Springs, NY (US); Nayan Vinodbhai Patel, Liberty Township, OH (US); Duane Douglas Thomsen, Lebanon, OH (US); Kevin Vandevoorde, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 479 days.

(21) Appl. No.: 15/086,384

(22) Filed: Mar. 31, 2016

(65) Prior Publication Data

US 2017/0284678 A1 Oct. 5, 2017

(51) Int. Cl.
*F23R 3/38* (2006.01)
*F02C 7/22* (2006.01)

(52) U.S. Cl.
CPC . *F23R 3/38* (2013.01); *F02C 7/22* (2013.01)

(58) Field of Classification Search
CPC .... F23R 3/28; F23R 3/286; F23R 3/38; F02C 7/22
See application file for complete search history.

(56) References Cited

U.S. PATENT DOCUMENTS

| | | | | |
|---|---|---|---|---|
| 6,272,840 | B1 | 8/2001 | Crocker et al. | |
| 6,986,255 | B2 | 1/2006 | Smith et al. | |
| 7,658,075 | B2 | 2/2010 | Von Der Bank | |
| 7,669,420 | B2 | 3/2010 | Spooner | |
| 7,779,636 | B2 * | 8/2010 | Buelow | F23R 3/14 60/742 |
| 7,926,744 | B2 | 4/2011 | Thomson et al. | |
| 8,096,135 | B2 * | 1/2012 | Caples | F02C 7/222 60/741 |

(Continued)

OTHER PUBLICATIONS

Mazaheri K et al.,"A parametric study using two design methodologies for pressure jet and swirl injectors", Aerospace Conference, 2012 IEEE, pp. 1-9, Oct. 11, 2009, Big Sky, MT.

*Primary Examiner* — Arun Goyal
(74) *Attorney, Agent, or Firm* — Joseph J. Christian

(57) ABSTRACT

A fuel injection system for use in a combustor of a turbine engine includes a mixer assembly including a mixer housing and a fuel nozzle assembly positioned radially inward of the mixer housing. The fuel nozzle assembly includes a substantially annular fuel injection housing and a substantially annular main fuel injector coupled to the fuel injection housing. The main fuel injector includes a body, a fuel delivery passage defined in the body, a swirl chamber defined in the body downstream of the fuel delivery passage, and a plurality of circumferentially-spaced fuel metering slots defined in the body and coupled in flow communication with and between the fuel delivery passage and the swirl chamber.

19 Claims, 5 Drawing Sheets

(56) References Cited

U.S. PATENT DOCUMENTS

| | | | | |
|---|---|---|---|---|
| 8,128,007 | B2 | 3/2012 | Thomson et al. | |
| 8,297,057 | B2 * | 10/2012 | Toon | F23D 14/74 60/746 |
| 8,365,531 | B2 | 2/2013 | Pidcock et al. | |
| 8,413,448 | B2 | 4/2013 | Hicks et al. | |
| 8,429,914 | B2 | 4/2013 | Gashi et al. | |
| 8,465,276 | B2 * | 6/2013 | Prade | F23L 7/002 431/12 |
| 8,646,275 | B2 | 2/2014 | Rackwitz et al. | |
| 8,733,105 | B2 | 5/2014 | Toon et al. | |
| 8,910,480 | B2 | 12/2014 | Suria et al. | |
| 8,910,483 | B2 | 12/2014 | Von Der Bank et al. | |
| 8,943,829 | B2 | 2/2015 | Bagchi et al. | |
| 9,046,039 | B2 | 6/2015 | Williams et al. | |
| 9,366,442 | B2 * | 6/2016 | Matsuyama | F23R 3/343 |
| 9,429,324 | B2 * | 8/2016 | Matsuyama | F23R 3/14 |
| 2004/0055270 | A1 * | 3/2004 | Blomeyer | F23D 14/02 60/39.12 |
| 2009/0056336 | A1 | 3/2009 | Chila et al. | |
| 2009/0255258 | A1 | 10/2009 | Bretz et al. | |
| 2015/0082797 | A1 * | 3/2015 | Matsuyama | F23R 3/14 60/746 |

* cited by examiner

TURBINE ENGINE FUEL INJECTION SYSTEM AND METHODS OF ASSEMBLING THE SAME

BACKGROUND

The field of the invention relates generally to turbine engines, and more particularly, to fuel distribution systems within turbine engines.

At least some known turbine engines include a forward fan, a core engine, and a power turbine. The core engine includes at least one compressor that provides pressurized air to a combustor where the air is mixed with fuel and ignited for use in generating hot combustion gases. Generated combustion gases flow downstream to one or more turbines that extract energy from the gas to power the compressor and provide useful work, such as powering an aircraft. A turbine section may include a stationary turbine nozzle positioned at the outlet of the combustor for channeling combustion gases into a turbine rotor downstream thereof. At least some known turbine rotors include a plurality of circumferentially-spaced turbine blades that extend radially outward from a rotor disk that rotates about a centerline axis of the engine.

In at least some known combustors, fuel and air are injected into an oxidizer stream from respective pluralities of circumferentially-spaced outlets. The independent streams of fuel and air interact to form a mixture, which produces a lean combustion flame that reduces NOx emissions. However, in some known systems, the fuel outlets are axially spaced from the air outlets and the outlets for the fuel and the air are circumferentially spaced. As such, the resulting fuel and air mixture is not uniformly mixed in the radial and circumferential directions. Also, in some known systems, the fuel injectors require a relatively high pressure drop across the fuel outlets to meet fuel-air mixing and emissions goals under maximum power operating conditions. As such, the fuel pump requires a high amount of power to provide the fuel with enough momentum to facilitate satisfactory mixing.

BRIEF DESCRIPTION

In one aspect, a fuel nozzle assembly for use in a combustor of a turbine assembly is provided. The fuel nozzle assembly includes a substantially annular fuel injection housing and a substantially annular main fuel injector coupled to the fuel injection housing. The main fuel injector includes a body, a fuel delivery passage defined in the body, a swirl chamber defined in the body downstream of the fuel delivery passage, and a plurality of circumferentially-spaced fuel metering slots defined in said body and coupled in flow communication with and between said fuel delivery passage and said swirl chamber.

In another aspect, a fuel injection system for use in a combustor of a turbine engine is provided. The fuel injection system includes a mixer assembly including a mixer housing and a fuel nozzle assembly positioned radially inward of the mixer housing. The fuel nozzle assembly includes a substantially annular fuel injection housing and a substantially annular main fuel injector coupled to the fuel injection housing. The main fuel injector includes a body, a fuel delivery passage defined in the body, a swirl chamber defined in the body downstream of the fuel delivery passage, and a plurality of circumferentially-spaced fuel metering slots defined in the body and coupled in flow communication between the fuel delivery passage and the swirl chamber.

In another aspect, a method of manufacturing a fuel injection system for use in a combustor of a turbine assembly is provided. The method includes forming a fuel delivery passage in a body of a main fuel injector. The main fuel injector is coupled to a fuel injection housing to define an inner flow passage therebetween, and the main fuel injector is also coupled to a mixer assembly to define an outer flow passage therebetween. The method also includes forming a swirl chamber in the main fuel injector body downstream of the fuel delivery passage, and forming a plurality of circumferentially-spaced fuel metering slots in the main fuel injector body. The plurality of fuel metering slots are formed such that the fuel metering slots are coupled in flow communication between the fuel delivery passage and the swirl chamber.

DRAWINGS

These and other features, aspects, and advantages of the present disclosure will become better understood when the following detailed description is read with reference to the accompanying drawings in which like characters represent like parts throughout the drawings, wherein.

Figure 1:
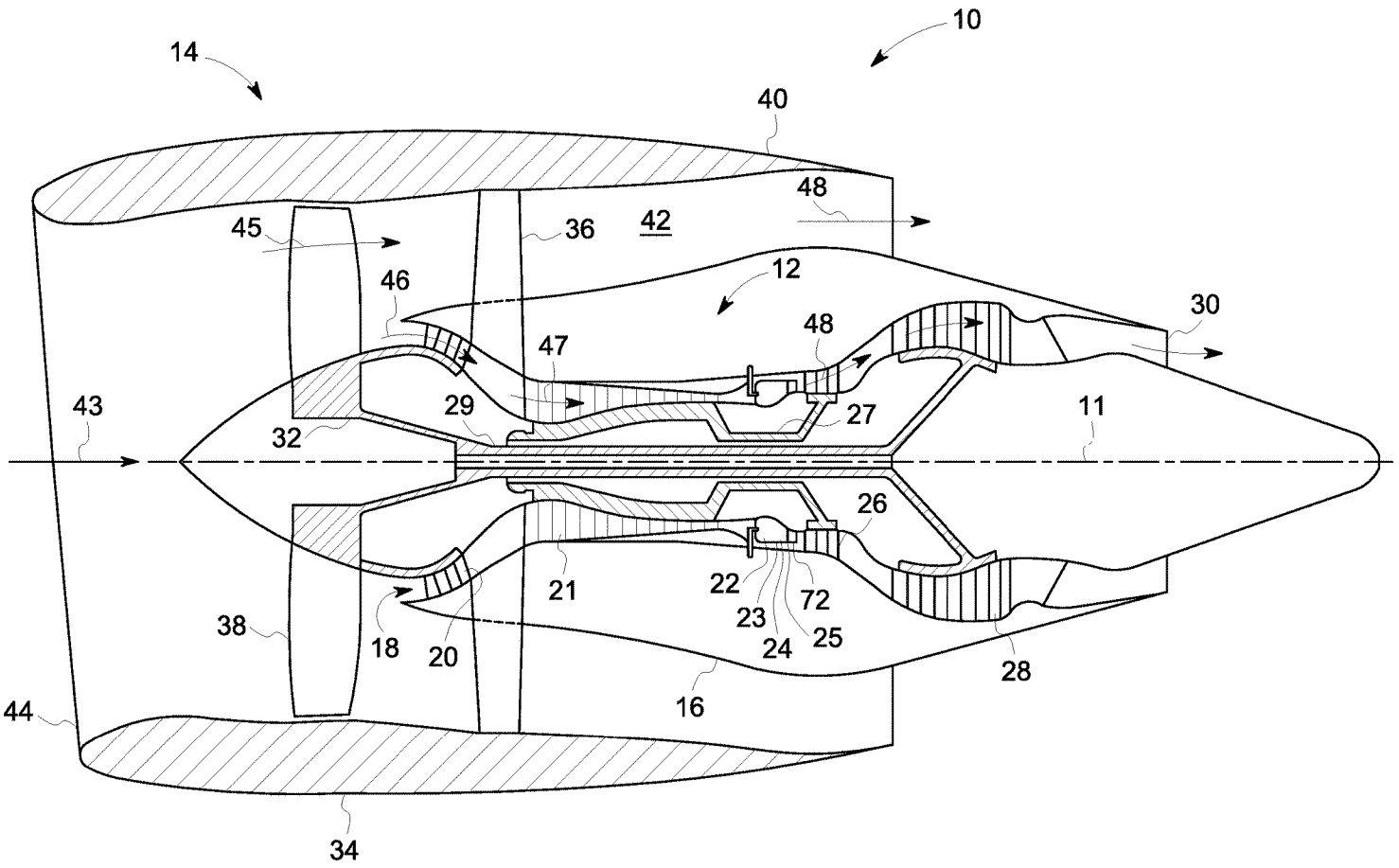
FIG. 1 is a cross-sectional view of an exemplary turbine engine assembly.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

Approximating language, as used herein throughout the specification and claims, is applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations are combined and interchanged; such ranges are identified and include all the sub-ranges contained therein unless context or language indicates otherwise.

As used herein, the term "first end" is used throughout this application to refer to directions and orientations located upstream in an overall axial flow direction of fluids with respect to a center longitudinal axis of a combustion chamber. The terms "axial" and "axially" are used throughout this application to refer to directions and orientations extending substantially parallel to a center longitudinal axis of a combustion chamber. Terms "radial" and "radially" are used throughout this application to refer to directions and orientations extending substantially perpendicular to a center longitudinal axis of the combustion chamber. Terms "upstream" and "downstream" are used throughout this application to refer to directions and orientations located in an overall axial flow direction with respect to the center longitudinal axis of the combustion chamber.

The fuel injection systems described herein facilitate efficient methods of turbine assembly operation. Specifically, the fuel injection system includes a mixer assembly and a fuel nozzle assembly positioned radially inward of the mixer assembly. The fuel nozzle assembly includes a fuel injection housing and a main fuel injector coupled to the fuel injection housing. The main fuel injector includes a body, a fuel delivery passage defined in the body, a swirl chamber defined in the body downstream of the fuel delivery passage, and a plurality of circumferentially-spaced fuel metering slots defined in the body and coupled in flow communication between the fuel delivery passage and the swirl chamber.

In operation, the fuel metering slots impart swirl into a flow of fuel and channel the fuel into the swirl chamber where the fuel forms a swirling sheet. The fuel is discharged through the swirl chamber outlet into an inner flow passage defined between the main injector and the fuel injection housing. High velocity fluid flow through the inner flow passage forces the fuel exiting the outlet to form a very thin sheet on a pre-filming surface of the main fuel injector. The inner fluid flow then carries the thin fuel sheet to a trailing edge of the main fuel injector where the fuel sheet and the inner fluid flow interact with an outer fluid flow, defined between the main injector and the mixer assembly, to facilitate forming a mixture of fuel and fluid that is evenly distributed in a circumferential direction such that the mixture forms a circumferential and radial uniform dispersal of fuel from the main fuel injector. port.

Accordingly, the fuel injection systems described herein provide various technological advantages and/or improvements over existing fuel nozzle assemblies and fuel injection systems. The disclosed fuel injection system enhances mixing of the fuel flowing from the main fuel injector with air supplied via inner and outer air flows, reduces production of undesirable emissions such as oxides of nitrogen or NOx, reduces the risk of flame holding that leads to improved durability of the hardware, and increases the efficiency of the turbine engine by reducing the pump pressure required to pump fuel through the engine. As a result of the above, various embodiments of the present disclosure facilitates extended combustor operating conditions, extend the life and/or maintenance intervals for various combustor components, maintain adequate design margins of flame holding, and/or reduce undesirable emissions. In addition, improved fuel-air mixing is also expected to yield better efficiency at a cruise condition.

FIG. 1 shows a cross-sectional view of an exemplary turbine engine assembly 10 having a longitudinal or centerline axis 11 therethrough. Although FIG. 1 shows a turbine engine assembly for use in an aircraft, assembly 10 is any turbine engine that facilitates operation as described herein, such as, but not limited to, a ground-based gas turbine engine assembly. Assembly 10 includes a core turbine engine 12 and a fan section 14 positioned upstream of core turbine engine 12. Core engine 12 includes a generally tubular outer casing 16 that defines an annular inlet 18. Outer casing 16 further encloses and supports a booster compressor 20 for raising the pressure of air entering core engine 12. A high pressure, multi-stage, axial-flow high pressure compressor 21 receives pressurized air from booster 20 and further increases the pressure of the air. The pressurized air flows to a combustor 22, generally defined by a combustion liner 23, and including a mixer assembly 24, where fuel is injected into the pressurized air stream, via one or more fuel nozzles 25 to raise the temperature and energy level of the pressurized air. The high energy combustion products flow from combustor 22 to a first (high pressure) turbine 26 for driving high pressure compressor 21 through a first (high pressure) drive shaft 27, and then to a second (low pressure) turbine 28 for driving booster compressor 20 and fan section 14 through a second (low pressure) drive shaft 29 that is coaxial with first drive shaft 27. After driving each of turbines 26 and 28, the combustion products leave core engine 12 through an exhaust nozzle 30 to provide propulsive jet thrust.

Fan section 14 includes a rotatable, axial-flow fan rotor 32 that is surrounded by an annular fan casing 34. It will be appreciated that fan casing 34 is supported from core engine 12 by a plurality of substantially radially-extending, circumferentially-spaced outlet guide vanes 36. In this way, fan casing 34 encloses the fan rotor 32 and a plurality of fan rotor blades 38. A downstream section 40 of fan casing 34 extends over an outer portion of core engine 12 to define a secondary, or bypass, airflow conduit 42 that provides propulsive jet thrust.

In operation, an initial air flow 43 enters turbine engine assembly 10 through an inlet 44 to fan casing 34. Air flow 43 passes through fan blades 38 and splits into a first air flow (represented by arrow 45) and a second air flow (represented by arrow 46) which enters booster compressor 20. The pressure of the second air flow 46 is increased and enters high pressure compressor 21, as represented by arrow 47. After mixing with fuel and being combusted in combustor 22 combustion products 48 exit combustor 22 and flow through the first turbine 26. Combustion products 48 then flow through the second turbine 28 and exit the exhaust nozzle 30 to provide thrust for the turbine engine assembly 10.

Fuel nozzles 25 in the mixer assembly 24 intake fuel from a fuel supply (e.g., liquid and/or gas fuel), mix the fuel with air, and distribute the air-fuel mixture into combustor 22 in a suitable ratio for optimal combustion, emissions, fuel consumption, and power output. Turbine engine assembly 10 includes mixer assembly 24 including the one or more fuel nozzles 25, having a fuel injection system, described in further detail below.

Figure 2:
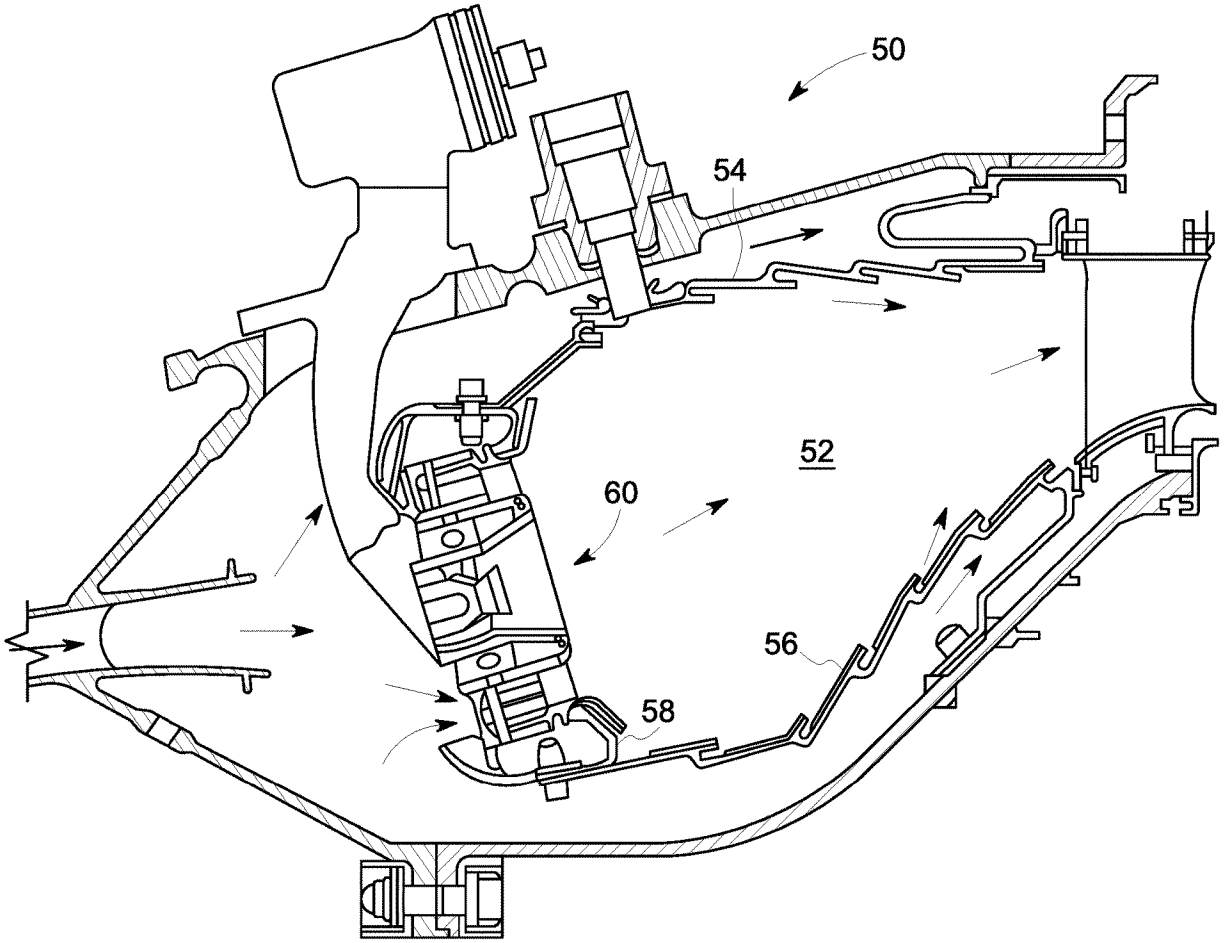
FIG. 2 is a cross-sectional view of a portion of an exemplary combustor that may be used with the turbine engine assembly shown in FIG. 1.

FIG. 2 is a cross-sectional view of a portion of an exemplary combustor 50 that may be used with turbine engine assembly 10. Combustor 50 defines a combustion chamber 52 in which combustor air is mixed with fuel and combusted. Combustor 50 includes an outer liner 54 and an inner liner 56. Outer liner 54 defines an outer boundary of the combustion chamber 52, and inner liner 56 defines an inner boundary of combustion chamber 52. An annular dome 58 is mounted upstream from outer liner 54 and inner liner 56 defines an upstream end of combustion chamber 52.

One or more fuel injection systems 60 are positioned on dome 58. In the exemplary embodiment, each fuel injection system 60 includes a mixer assembly and a fuel nozzle assembly, each described in further detail below, for delivery of a mixture of fuel and air to combustion chamber 52. Other features of the combustion chamber 52 are conventional and will not be discussed in further detail.

Figure 3:
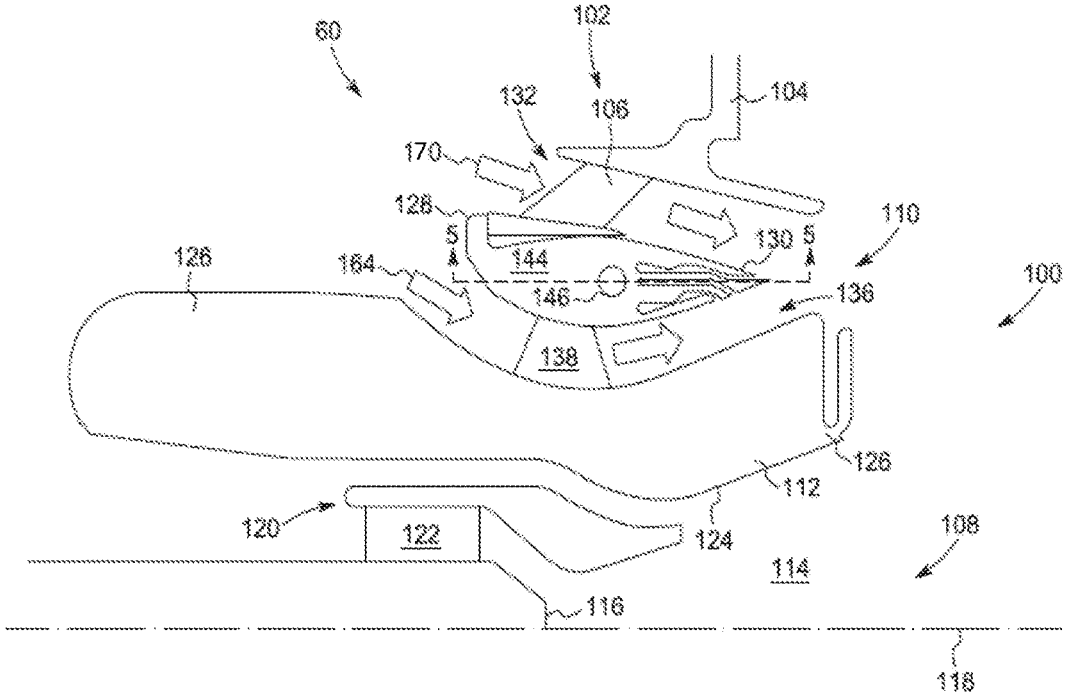
FIG. 3 is a cross-sectional view at a first circumferential location of an exemplary fuel nozzle assembly including an exemplary fuel injection system that may be used with the combustor shown in FIG. 2.

FIG. 3 is a cross-sectional view of a fuel injection system 60 including fuel nozzle assembly 100 and a mixer assembly 102 that may be used with combustor 50 (shown in FIG. 2). Mixer assembly 102 includes a mixer housing 104 and a plurality of mixer swirler vanes 106 extending radially inward from mixer housing 104. In the exemplary embodiment, fuel nozzle assembly 100 includes a pilot nozzle 108 and a main nozzle 110 radially spaced from pilot nozzle 108. Pilot nozzle 108 includes an annular pilot housing 112 defining a hollow interior 114. A pilot fuel injector 116 is mounted in annular pilot housing 112 along a centerline 118 of fuel injection system 60. Pilot fuel injector 116 dispenses droplets of fuel into hollow interior 114 of pilot housing 112.

In the exemplary embodiment, pilot nozzle 108 also includes a concentrically mounted axial pilot swirler 120. Swirler 120 includes a plurality of vanes 122 and is positioned upstream from pilot fuel injector 116. Each of vanes 122 is skewed relative to centerline 118 of fuel injection system 60 for swirling air traveling through pilot swirler 120 so the air mixes with the droplets of fuel dispensed by pilot fuel injector 116 to form a fuel-air mixture selected for combustion during ignition and low power settings of the engine. Although pilot nozzle 108 of the disclosed embodiment has a single axial swirler 120, alternative embodiments of pilot nozzle 108 include more swirlers 120. For those embodiments when more than one swirler 120 is included in pilot nozzle 108, swirlers 120 are configured to have differing numbers of vanes 122 as well as configured to swirl air in the same direction or in opposite directions. Further, pilot interior 114 is sized and pilot swirler 120 airflow and swirl angle are selected to facilitate good ignition characteristics, lean stability, less smoke production, and low carbon monoxide (CO) and hydrocarbon (HC) emissions at low power conditions.

Pilot housing 112 includes a generally diverging inner surface 124 adapted to provide controlled diffusion for mixing the pilot air with the main mixer airflow. The diffusion also reduces the axial velocities of air passing through pilot nozzle 108 and facilitates recirculation of hot gasses to stabilize the pilot flame.

In the exemplary embodiment, main nozzle 110 includes a main fuel injection housing 126, surrounding pilot housing 112, and an annular main fuel injector 128 surrounding main housing 126. Main fuel injector 128 includes a radially outer surface 130 that at least partially defines an outer air flow passage 132 between main injector 128 and mixer housing 104 such that mixer vanes 106 extend through outer passage 130. Similarly, main fuel injector 128 includes a radially inner surface 134 that at least partially defines an inner air flow passage 136 between main injector 128 and main fuel injection housing 126. Furthermore, main nozzle 110 includes a plurality of main swirler vanes 138 positioned between main fuel injector 128 and main housing 126. More specifically, vanes 138 extend between main injector inner surface 134 and a main housing outer surface 140 such that main vanes 138 extend through inner passage 136

Figure 4:
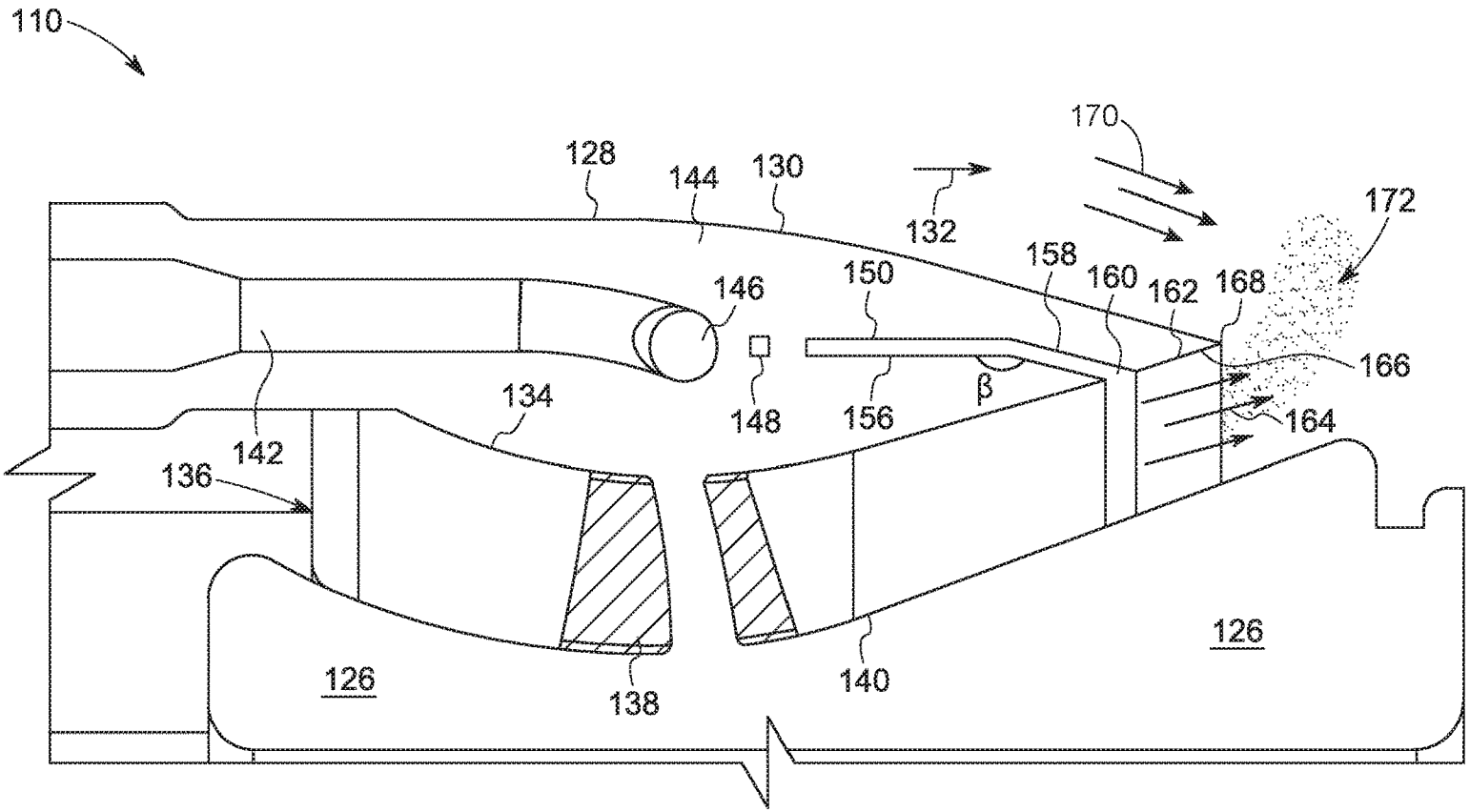
FIG. 4 is an enlarged cross-sectional view at a second circumferential location of an exemplary main fuel injection nozzle of the fuel nozzle assembly shown in FIG. 3.
Figure 5:
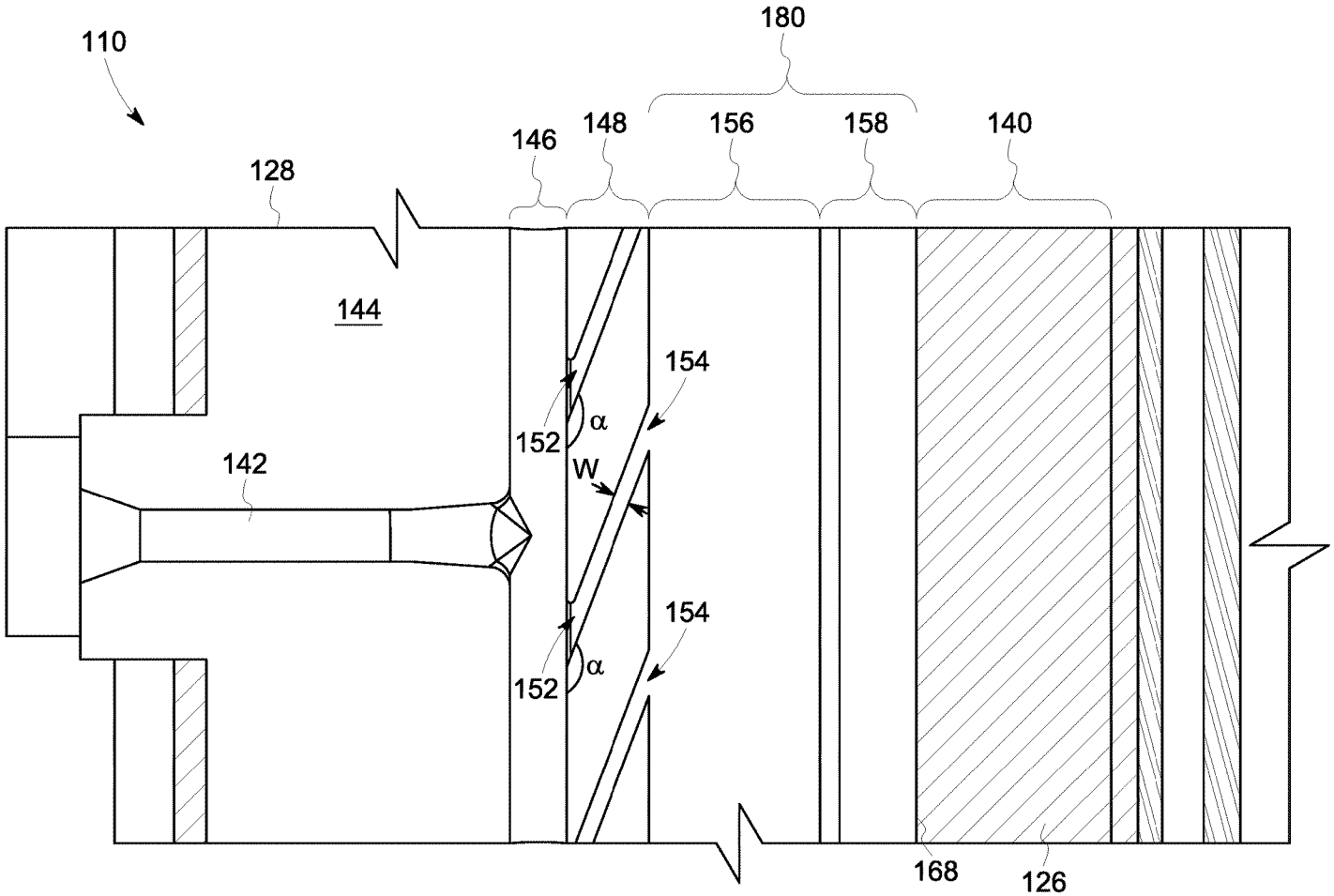
FIG. 5 is a top cross-sectional view of the main fuel injection nozzle shown in FIG. 4 at location 5-5 shown in FIG. 3.

FIG. 4 is an enlarged cross-sectional view at a second circumferential location of main fuel injection nozzle 110 of fuel nozzle assembly 100, and FIG. 5 is a top cross-sectional view of main fuel injection nozzle 128 shown in FIG. 4 at location 5-5 (shown in FIG. 3). In the exemplary embodiment, main fuel injector 128 of fuel nozzle assembly 100 includes at least one fuel inlet 142 coupled in fluid communication with a fuel manifold (not shown). Fuel inlet 142 channels fuel downstream through a body 144 of main fuel injector 128 and discharges the fuel into a circumferential fuel delivery passage 146. In the exemplary embodiment, fuel delivery passage 146 is a single, continuous annular tube that delivers fuel circumferentially to each main injector 128. In another embodiment, fuel delivery passage 146 is a split ring or a U-shaped tube. Alternatively, fuel nozzle assembly 100 includes a plurality of fuel delivery passages 146 that each delivers fuel to fewer than all of the fuel metering slots 148.

In the exemplary embodiment, main fuel injector 128 includes a plurality of fuel metering slots 148 and a single, continuous swirl chamber 150. Fuel metering slots 148 are circumferentially-spaced within main injector body 144 and are coupled in flow communication between fuel delivery passage 146 and swirl chamber 150. Specifically, each fuel metering slot 148 includes an inlet 152 in flow communication with fuel delivery passages 146 and an outlet 154 in flow communication with swirl chamber 150. In the exemplary embodiment, fuel metering slots 148 are oriented obliquely with respect to centerline 118 and to fuel delivery passage 146 such that inlet 152 is circumferentially offset from outlet 154. As such, fuel metering slots 148 channel the fuel in a direction having an axial component and a circumferential component. More specifically, fuel metering slots 148 are oriented obliquely to fuel delivery passage 146 at angle $\alpha$ within a range between and including approximately 95° and approximately 170°, and more specifically, within a range between and including approximately 120° and approximately 160°, and even more specifically, within a range between and including approximately 135° and approximately 150°. Generally, angle $\alpha$ is optimized to provide optimal spreading of the fuel within swirl chamber 150.

As the fuel travels circumferentially through fuel delivery passage 146, the fuel enters fuel metering slots 148 via inlets 152 and continues to travel partially circumferentially such that as the fuel exits slots 148 via outlets 154, it continues to swirl in the circumferential direction within swirl chamber 150. As such, the fuel spreads evenly into a thin sheet of fuel on the radially outer wall of swirl chamber 150 such that the volume of swirl chamber 150 is evenly filled with fuel to preclude hot air being ingested from downstream. Adequate pressure drop across fuel metering slots 148 ensures even fueling of all slots.

In the exemplary embodiment, each fuel metering slot 148 includes a substantially rectangular cross-section. Alternatively, fuel metering slots 148 include any cross-sectional shape, such as but not limited to circular, that facilitates operation of main fuel injector 128 as described herein. Furthermore, in the exemplary embodiment, fuel metering slots 148 include a substantially constant width W such that inlet 152 and outlet 154 are equal in size. Alternatively, fuel metering slots 148 include a width W that varies between inlet 152 and outlet 154. For example, in one embodiment, fuel metering slots 148 are convergent such that inlet 152 is larger in area that outlet 154. In another embodiment, fuel metering slots 148 are divergent such that inlet 152 is smaller in area that outlet 154. In yet another embodiment, inlet 152 and outlet 154 are substantially similar in size, but width W of fuel metering slots 148 vary therebetween.

Fuel metering slots 148 regulate the fuel flow through main injector 128 such that a pressure drop exists across fuel metering slots 148. To ensure uniform filling of the volume of swirl chamber 150, fuel metering slots 148 are sized to provide the maximum pressure drop that fuel system 60 can deliver at the maximum required engine flow. Accordingly, the minimum required fuel flow for light off will also uniformly fill the volume of swirl chamber 150.

In the exemplary embodiment, once the fuel exits fuel metering slots 148 via outlet 154, the flows downstream into swirl chamber 150. Swirl chamber 150 includes a first portion 156, a second portion 158, and an outlet 160. In the exemplary embodiment, first portion 156 is substantially parallel to centerline 118 (shown in FIG. 3) and second portion 158 is oriented obliquely with respect to first portion 156 such that second portion 158 is oriented towards pilot nozzle 108 (shown in FIG. 3). More specifically, second portion 158 is oriented obliquely with respect to first portion 156 at angle β within a range between and including approximately 90° and approximately 180°, and more specifically, within a range between and including approximately 135° and approximately 180°. Generally, angle β is optimized to provide optimal spreading of the fuel downstream of outlet 160.

As described herein, swirl chamber 150 defines a single, continuous, circumferential slot between fuel metering slots 148 and inner flow passage 136 that enables the fuel to travel both circumferentially and axially toward outlet 160. As the fuel exits fuel metering slots 148 via outlets 154, it continues to swirl in the circumferential direction within swirl chamber 150, and, as such, spreads evenly into a thin sheet of fuel on the radially outer wall of second portion 158 of swirl chamber 150 until it is discharged via outlet 160.

In the exemplary embodiment, inner surface 134 of main injector body 128 includes a pre-filming surface 162 downstream of outlet slot 160 of swirl chamber 150. As the fuel exits swirl chamber 150 via outlet slot 160, it encounters a high velocity air flow 164 traveling through inner air passage 136. Airflow 164 forces the fuel against pre-filming surface 162 such that a thin sheet 166 of fuel is formed on pre-filming surface 162. Because outlet 160 is a continuous slot, fuel sheet 166 is evenly distributed circumferentially along pre-filming surface 162 between outlet 160 and a trailing edge 168 of main fuel injector 128. In the exemplary embodiment, pre-filming surface 162 is substantially smooth. Alternatively, pre-filming surface 162 includes aerodynamic and/or geometric features, such as but not limited to dimples or groves, to enhance the thinning of fuel sheet 166 on pre-filming surface 162 and for improved fuel sheet atomization downstream of trailing edge 168.

As air flow 164 continues through passage 136, air flow 164 carries fuel sheet 166 over trailing edge 168 where fuel sheet 166 encounters a second high velocity air flow 170 traveling through outer air passage 132. Air flows 164 and 170 interact at trailing edge 168, or immediately aft thereof, to shear atomize fuel sheet 166. More specifically, the high velocity air flows 162 and 170 break fuel sheet 166 into small particles and droplets which subsequently evaporate and mix both circumferentially and radially with air flows 164 and 170 to form a fuel/air mixture 172 downstream of main injector 128. As described above, circumferential outlet slot 160 spreads the fuel evenly circumferentially, and air flows 164 and 170 facilitates evenly distributing the fuel in a radial direction such that mixture 172 includes a circumferentially and radially uniform dispersal of fuel.

Exemplary embodiments of a fuel injection system for use in a combustion chamber of a turbine assembly are described in detail above. The fuel injection system includes a mixer assembly including a mixer housing and a fuel nozzle assembly positioned radially inward of the mixer housing. The fuel nozzle assembly includes a substantially annular fuel injection housing and a substantially annular main fuel injector coupled to the fuel injection housing. The main fuel injector includes a body, a fuel delivery passage defined in the body, a swirl chamber defined in the body downstream of the fuel delivery passage, and a plurality of circumferentially-spaced fuel metering slots defined in the body and coupled in flow communication between the fuel delivery passage and the swirl chamber. In operation, the fuel metering slots impart swirl into a flow of fuel and channel the fuel into the swirl chamber where the fuel forms a swirling sheet. The fuel is discharged through the swirl chamber outlet into an inner flow passage. High velocity fluid flow through the inner flow passage forces the fuel exiting the outlet to form a very thin sheet on a pre-filming surface of the main fuel injector. The inner fluid flow then carries the thin fuel sheet to a trailing edge of the main fuel injector where the fuel sheet and the inner fluid flow interact with an outer fluid flow to facilitate forming a mixture of fuel and fluid that is evenly distributed in the radial and circumferential directions such that the mixture forms a circumferential and radial uniform dispersal of fuel from the main fuel injector.

An exemplary technical effect of the methods, systems, and apparatus described herein includes at least one of: (a) enhancing the mixing of the fuel flowing from the main fuel injector with air supplied via inner and outer air flows; (b) reducing production of undesirable emissions such as oxides of nitrogen or $NO_x$; (c) reducing the risk of flame holding that leads to improved durability of the hardware, and thereby reducing the need for inspection, maintenance, or replacement; and (d) increasing efficiency of the turbine engine by reducing the pump pressure required to pump fuel through the engine. As a result of the above, various embodiments of the present disclosure facilitate extended combustor operating conditions, extend the life and/or maintenance intervals for various combustor components, maintain adequate design margins of flame holding, and/or reduce undesirable emissions. In addition, improved fuel-air mixing is also expected to yield better efficiency at cruise condition.

Exemplary embodiments of methods, systems, and apparatus for a fuel injection system are not limited to the specific embodiments described herein, but rather, components of systems and steps of the methods may be utilized independently and separately from other components and steps described herein. For example, the methods may also be used in combination with other fuel injection assemblies, and are not limited to practice with only the fuel injection system and methods as described herein. Rather, the exemplary embodiment can be implemented and utilized in connection with many other applications, equipment, and systems that may benefit from the advantages described herein.

Although specific features of various embodiments of the disclosure may be shown in some drawings and not in others, this is for convenience only. In accordance with the principles of the disclosure, any feature of a drawing may be referenced and claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A fuel injection system for use in a combustor of a turbine assembly, said fuel injection system comprising:

a mixer housing;

a main nozzle disposed radially inward of the mixer housing;

a pilot nozzle disposed radially inward of the main nozzle, the pilot nozzle comprising;

an annular pilot housing defining a diverging inner surface and a hollow interior; and a pilot fuel injector disposed radially inward of the diverging inner surface in the hollow interior of the annular pilot housing along a centerline of the fuel injection system;

the main nozzle, radially spaced from the pilot nozzle, the main nozzle comprising:

a substantially annular main fuel injection housing surrounding the pilot nozzle;

a substantially annular main fuel injector surrounding the substantially annular main fuel injection housing and coupled to said substantially annular main fuel injection housing, said substantially annular main fuel injector comprising:

a body;

a fuel delivery passage defined in said body;

a swirl chamber defined in said body downstream of said fuel delivery passage; and a plurality of circumferentially-spaced fuel metering slots defined in said body to impart swirl into fuel and channel the fuel into the swirl chamber forming a swirling sheet of the fuel on a radially outer wall of the swirl chamber, each of the plurality of circumferentially-spaced fuel metering slots including an inlet coupled in flow communication with said fuel delivery passage and an outlet coupled in flow communication with and disposed upstream said swirl chamber, and a swirler disposed between the substantially annular main fuel injection housing and the substantially annular main fuel injector; and a second swirler comprising a plurality of mixer swirler vanes disposed in an outer flow passage defined between the mixer housing and the body, the outer flow passage oriented at an acute angle relative to the centerline of the fuel injection system.

2. The fuel injection system in accordance with claim 1, wherein plurality of said fuel metering slots are oriented obliquely with respect to said fuel delivery passage to facilitate swirling of a flow of the fuel within said swirl chamber.

3. The fuel injection system in accordance with claim 2, wherein plurality of said fuel metering slots are oriented at an angle within a range between and including approximately 95° and approximately 170° with respect to said fuel delivery passage.

4. The fuel injection system in accordance with claim 1, wherein said inlet is circumferentially offset from said outlet.

5. The fuel injection system in accordance with claim 1, wherein said swirl chamber comprises a first portion and a second portion obliquely oriented with respect to said first portion.

6. The fuel injection system in accordance with claim 1, wherein said body comprises a radially inner surface and said swirl chamber defines a continuous circumferential slot defining an outlet defined in said radially inner surface.

7. The fuel injection system in accordance with claim 6, wherein said body further comprises a trailing edge and said radially inner surface comprises a pre-filming surface between said outlet and said trailing edge.

8. The fuel injection system in accordance with claim 7, wherein said fuel injection housing and said main fuel injector define a radially inner flow passage therebetween configured to channel a flow of fluid, wherein the flow of th fluid is configured to form the swirling sheet of the fuel on said pre-filming surface downstream of said outlet.

9. A fuel injection system for use in a combustor of a turbine engine, the fuel injection system comprising:

a mixer assembly comprising a mixer housing;

a fuel nozzle assembly positioned radially inward of said mixer housing, said fuel nozzle assembly comprising:

a pilot nozzle comprising:

an annular pilot housing defining a diverging inner surface and a hollow interior;

a pilot fuel injector disposed radially inward of the diverging inner surface in the hollow interior of the annular pilot housing along a centerline of the fuel nozzle assembly;

at least one concentrically mounted axial pilot swirler disposed about the pilot fuel injector and positioned upstream from pilot fuel injector; and a main nozzle, radially spaced from the pilot nozzle, the main nozzle comprising:

a substantially annular main fuel injection housing surrounding the pilot nozzle; and a substantially annular main fuel injector surrounding the substantially annular main fuel injection housing and coupled to said substantially annular main fuel injection housing, said substantially annular main fuel injector comprising:

a body;

a fuel delivery passage defined in said body;

a swirl chamber defined in said body downstream of said fuel delivery passage; and a plurality of circumferentially-spaced fuel metering slots defined in said body to impart swirl into fuel and channel the fuel into the swirl chamber forming a swirling sheet of the fuel on a radially outer wall of the swirl chamber, each of said plurality of circumferentially-spaced fuel metering slots including an inlet coupled in flow communication with said fuel delivery passage and an outlet coupled in flow communication with and disposed upstream said swirl chamber, and a main swirler disposed between the substantially annular main fuel injection housing and the substantially annular main fuel injector; and a swirler comprising a plurality of mixer swirler vanes disposed within an outer flow passage defined between the mixer housing and the body, the outer flow passage oriented at an acute angle relative to the centerline of the fuel nozzle assembly.

10. The fuel injection system in accordance with claim 9, wherein plurality of said fuel metering slots are oriented obliquely with respect to said fuel delivery passage to facilitate swirling of a flow of the fuel within said swirl chamber.

11. The fuel injection system in accordance with claim 10, wherein plurality of said fuel metering slots are oriented at an angle within a range between and including approximately 95° and approximately 170° with respect to said fuel delivery passage.

12. The fuel injection system in accordance with claim 9, wherein said mixer housing and said main fuel injector define the outer flow passage therebetween, and wherein said main fuel injector and said fuel injection housing define an inner flow passage therebetween.

13. The fuel injection system in accordance with claim 12, wherein said swirl chamber comprises an outlet configured to discharge the fuel into said inner flow passage, and wherein said body further comprises a trailing edge and a pre-filming surface defined between said outlet and said trailing edge.

14. The fuel injection system in accordance with claim 13, wherein an inner flow of fluid through said inner flow passage forms the swirling sheet of the fuel on said pre-filming surface downstream of said outlet.

15. The fuel injection system in accordance with claim 14, wherein an outer flow of the fluid flowing through said outer flow passage, said inner flow of the fluid, and said swirling sheet of the fuel are configured to interact at said trailing edge to facilitate uniformly mixing said inner flow of the fluid and said outer flow of the fluid and said sheet of the fuel circumferentially and radially.

16. A method of manufacturing a fuel injection system for use in a combustor of a turbine assembly, said method comprising:

disposing a main fuel injection housing about a pilot nozzle, wherein the pilot nozzle comprises an annular pilot housing defining a diverging inner surface and a hollow interior, and a pilot fuel injector disposed radially inward of the diverging inner surface in the hollow interior of the annular pilot housing along a centerline of the fuel injection system, and at least one concentrically mounted axial pilot swirler disposed about the pilot fuel injector and positioned upstream from pilot fuel injector;

forming a fuel delivery passage in a body of a main fuel injector, wherein the main fuel injector is coupled to the main fuel injection housing to define an inner flow passage therebetween and having a main swirler disposed between the main fuel injection housing and the main fuel injector, and wherein the main fuel injector is coupled to a mixer assembly to define an outer flow passage therebetween having a swirler comprising a plurality of mixer swirler vanes disposed therein the outer flow passage, the outer flow passage oriented at an acute angle relative to the centerline of the fuel injection system;

forming a swirl chamber in the body of the main fuel injector downstream of the fuel delivery passage; and forming a plurality of circumferentially-spaced fuel metering slots in the body of the main fuel injector to impart swirl into fuel and channel the fuel into the swirl chamber forming a swirling sheet of the fuel on a radially outer wall of the swirl chamber, each of the plurality of circumferentially-spaced fuel metering slots includes an inlet in flow communication with the fuel delivery passage and an outlet in flow communication with and disposed upstream the swirl chamber.

17. The method in accordance with claim 16, wherein forming plurality of said fuel metering slots comprises forming the plurality of said fuel metering slots such that the plurality of said fuel metering slots are oriented obliquely with respect to the fuel delivery passage to facilitate swirling of a flow of the fuel within the swirl chamber.

18. The method in accordance with claim 16, wherein forming the swirl chamber comprises forming a swirl chamber outlet configured to discharge a flow of the fuel into the inner flow passage, wherein the body includes a trailing edge and a pre-filming surface defined between the swirl chamber outlet and the trailing edge, and wherein an inner flow of fluid through the inner flow passage is configured to form the swirling sheet of the fuel on the pre-filming surface downstream of the swirl chamber outlet.

19. The method in accordance with claim 18, wherein coupling the main fuel injection housing and the mixer assembly to the main fuel injector comprises coupling the main fuel injection housing and the mixer assembly to the main fuel injector such that an outer flow of the fluid flowing through the outer flow passage, the inner flow of the fluid, and the sheet of the fuel are configured to interact at the trailing edge to facilitate uniformly mixing the inner flow of the fluid and outer flow of the fluid and the sheet of the fuel circumferentially and radially.

* * * * *